US008869454B2

(12) United States Patent
Griffin, Jr. et al.

(10) Patent No.: US 8,869,454 B2
(45) Date of Patent: Oct. 28, 2014

(54) SECURITY DEVICE FOR A DOOR

(76) Inventors: James Patrick Griffin, Jr., Toronto (CA); James Patrick Griffin, Toronto (CA)

( * ) Notice: Subject to any disclaimer, the term of this patent is extended or adjusted under 35 U.S.C. 154(b) by 757 days.

(21) Appl. No.: 10/619,154

(22) Filed: Jul. 14, 2003

(65) Prior Publication Data

US 2005/0011132 A1 Jan. 20, 2005

(51) Int. Cl.
*E05F 7/00* (2006.01)

(52) U.S. Cl.
USPC ..... 49/462; 49/460; 49/501

(58) Field of Classification Search
USPC ..... 49/462, 501, 460
See application file for complete search history.

(56) References Cited

U.S. PATENT DOCUMENTS

| | | | | | |
|---|---|---|---|---|---|
| 306,806 | A | * | 10/1884 | Barnes | 49/462 |
| 631,431 | A | | 8/1899 | Phelps | |
| 940,261 | A | | 11/1909 | MaGruder | |
| 950,926 | A | | 3/1910 | Keil | |
| 2,018,663 | A | * | 10/1935 | Fitch | 52/784.13 |
| 2,489,072 | A | * | 11/1949 | Ausubel | 16/402 |
| 3,271,919 | A | * | 9/1966 | Olton | 52/800.13 |
| 3,666,309 | A | | 5/1972 | Zarzycki | |
| 3,673,605 | A | | 6/1972 | Allenbaugh | |
| 3,910,612 | A | * | 10/1975 | Guiraud | 292/33 |
| 3,955,387 | A | | 5/1976 | Best et al. | |
| 4,118,827 | A | * | 10/1978 | Yamamoto | 16/252 |
| 4,129,020 | A | | 12/1978 | Gonzalez | |
| 4,130,311 | A | | 12/1978 | Sushan | |
| 4,139,999 | A | | 2/1979 | Allenbaugh | |
| 4,141,234 | A | | 2/1979 | Hoos | |
| 4,397,168 | A | | 8/1983 | Rotondi et al. | |
| 4,484,463 | A | | 11/1984 | Hennessy | |
| 4,522,048 | A | | 6/1985 | Davis | |
| 4,534,487 | A | | 8/1985 | Rapata | |
| 4,548,061 | A | | 10/1985 | Nilsson | |
| 4,548,062 | A | | 10/1985 | Kaufman | |
| 4,752,517 | A | * | 6/1988 | Beitel | 428/122 |
| 4,763,499 | A | | 8/1988 | Boyle | |
| 4,858,384 | A | * | 8/1989 | Blankenship | 49/460 |
| 4,865,370 | A | * | 9/1989 | Francis | 292/340 |
| 4,869,087 | A | | 9/1989 | Day | |
| 4,977,705 | A | * | 12/1990 | Guetle, Jr. | 49/478.1 |
| 5,031,946 | A | * | 7/1991 | Yarrow | 292/337 |
| 5,070,650 | A | * | 12/1991 | Anderson | 49/460 |
| 5,131,189 | A | | 7/1992 | Mascotte | |

(Continued)

FOREIGN PATENT DOCUMENTS

| | | | |
|---|---|---|---|
| CA | 2088726 | A1 | 8/1994 |
| FR | 2409368 | A | 6/1979 |
| FR | 2595748 | A | 9/1987 |
| GB | 2265664 | A | 10/1993 |

*Primary Examiner* — Gregory J. Strimbu
(74) *Attorney, Agent, or Firm* — Scott Pundsack; Borden Ladner Gervais LLP

(57) ABSTRACT

A security device for a door comprises a U-shaped reinforcing plate on the vertical edge of a door on the deadbolt side of the door and an elongated frame plate. The door reinforcing plate and the frame plate are made of a hardened material such as cold rolled steel. The door reinforcing plate extends substantially the entire length of the door. A force applied to the door by a would-be intruder is transmitted from the deadbolt to the door reinforcing plate and the elongated frame plate, which then distribute the force over the vertical edge of the door and a significant part of the frame, respectively.

11 Claims, 7 Drawing Sheets

(56) References Cited

U.S. PATENT DOCUMENTS

| | | | | | |
|---|---|---|---|---|---|
| 5,316,353 | A | | 5/1994 | McKernan | |
| 5,400,628 | A | | 3/1995 | Ryan | |
| 5,475,044 | A | * | 12/1995 | Stein | 524/188 |
| 5,566,509 | A | * | 10/1996 | Long | 49/462 |
| 5,603,194 | A | * | 2/1997 | Fridlyand et al. | 52/515 |
| 5,737,878 | A | * | 4/1998 | Raulerson et al. | 49/462 |
| 5,822,926 | A | | 10/1998 | Koike et al. | |
| 5,915,764 | A | * | 6/1999 | MacDonald | 292/66 |
| 5,950,467 | A | | 9/1999 | Dong | |
| 6,318,026 | B1 | | 11/2001 | Ayres et al. | |
| 6,406,076 | B1 | | 6/2002 | Zarzycki, Jr. | |
| 6,691,466 | B2 | * | 2/2004 | Childress | 49/462 |
| 2003/0029093 | A1 | | 2/2003 | Childress | |

* cited by examiner

SECURITY DEVICE FOR A DOOR

FIELD OF THE INVENTION

This invention relates to security devices for doors.

BACKGROUND OF THE INVENTION

Conventionally, a door may be secured by a lock having a metal deadbolt. A deadbolt is generally strong enough that it will not break if an intruder tries to break down the door. When a door fails, however, it is commonly due to the deadbolt or door latch breaking through the door or the door frame as shown in FIG. 1.

U.S. Pat. No. 4,763,499 to Boyle teaches a door security system that includes a lock security assembly, a reinforced strike plate and a door hinge assembly. The lock security assembly includes a wraparound cover plate that encircles the exterior lock portion, wraps around the edge of the door over the deadbolt, then encircles the interior lock portion. The cover plate does not extend significantly in the vertical direction along the edge of the door from the deadbolt. The lock security assembly further includes angle iron-shaped members attached to the wraparound cover plate. The angle iron-shaped members extend horizontally from the cover plate and reinforce the door proximate to the deadbolt. The reinforced strike plate is attached to the doorjamb and does not extend significantly in the vertical direction along the door jamb. The door hinge assembly reinforces the door and the door jamb proximate to the hinges.

U.S. Pat. No. 3,666,309 to Zarzycki teaches a plate that fits over the edge of a door and is used with a doorknob having the tumbler assembly located within. The plate does not extend significantly in the vertical direction along the edge of the door. Further, the plate does not accommodate a deadbolt assembly.

U.S. Pat. No. 3,673,605 to Allenbaugh teaches a plate covering the edge of the door proximate to the deadbolt and latch. The plate does not extend significantly in the vertical direction along the edge of the door.

U.S. Pat. No. 4,141,234 to Hoos teaches a guard mount structure for a deadbolt assembly. The guard covers only the edge of the door proximate to the deadbolt assembly.

U.S. Pat. No. 4,397,168 to Rotondi et al. teaches an L-shaped bracket for reinforcing a door proximate to the deadbolt and door latch. The L-shaped bracket is a plate including a first leg covering a portion of one face of the door and an integral second leg affixed to the edge of the door. The first leg includes passages for the doorknob and the deadbolt lock assembly. The second leg includes passages for the door latch and the deadbolt. The bracket doesn't continue to the inner face of the door and does not extend significantly in the vertical direction along the edge of the door.

The devices in the art tend to reinforce only one of the door frame or the door. Further, the devices in the art only cover the area proximate to the lock in the door or the strike plate in the door frame. Thus the force applied by the intruder trying to break down the door is directed in the proximity of the deadbolt.

Therefore, a security device for a door that reinforces a larger portion of the door and distributes an impact applied to the door is desired in the art.

SUMMARY OF THE INVENTION

The invention comprises, in one form thereof, a security device for a door comprising a door reinforcing plate that is angled and crimped into a U-shape and over bend mounted to the edge of the door and a frame plate, which is a flat plate mounted to the door frame. This security device reinforces a larger part of the door and door frame than other reinforcing plates in the art and in an embodiment, distributes the force due to an impact on the door over substantially the entire length of the door.

BRIEF DESCRIPTION OF THE DRAWINGS

The above-mentioned and other features and advantages of this invention, and the manner of attaining them, will become apparent and be better understood by reference to the following description of the embodiments of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DETAILED DESCRIPTION

Figure 1:
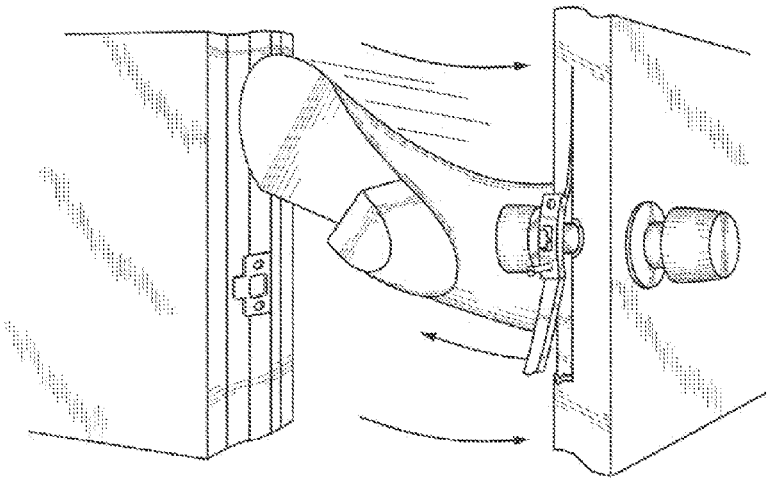
FIG. 1 (PRIOR ART)
FIG. 1 is an isometric view of a door secured by a conventional lock breaking under the impact applied by an intruder.

Referring to FIGS. 2, 2*a*, 2*b*, and 3, a security device 10 of the present invention includes a door reinforcing plate 12 and a frame plate 14. The security device 10 cooperates with a new or existing door 16, a door frame 18 including a deadbolt receptacle 19*a*, a door latch receptacle 19*b*, and a door jamb 25, deadbolt lock assembly 20 including deadbolt 21, and door latch assembly 22 including door latch 23.

Figure 2:
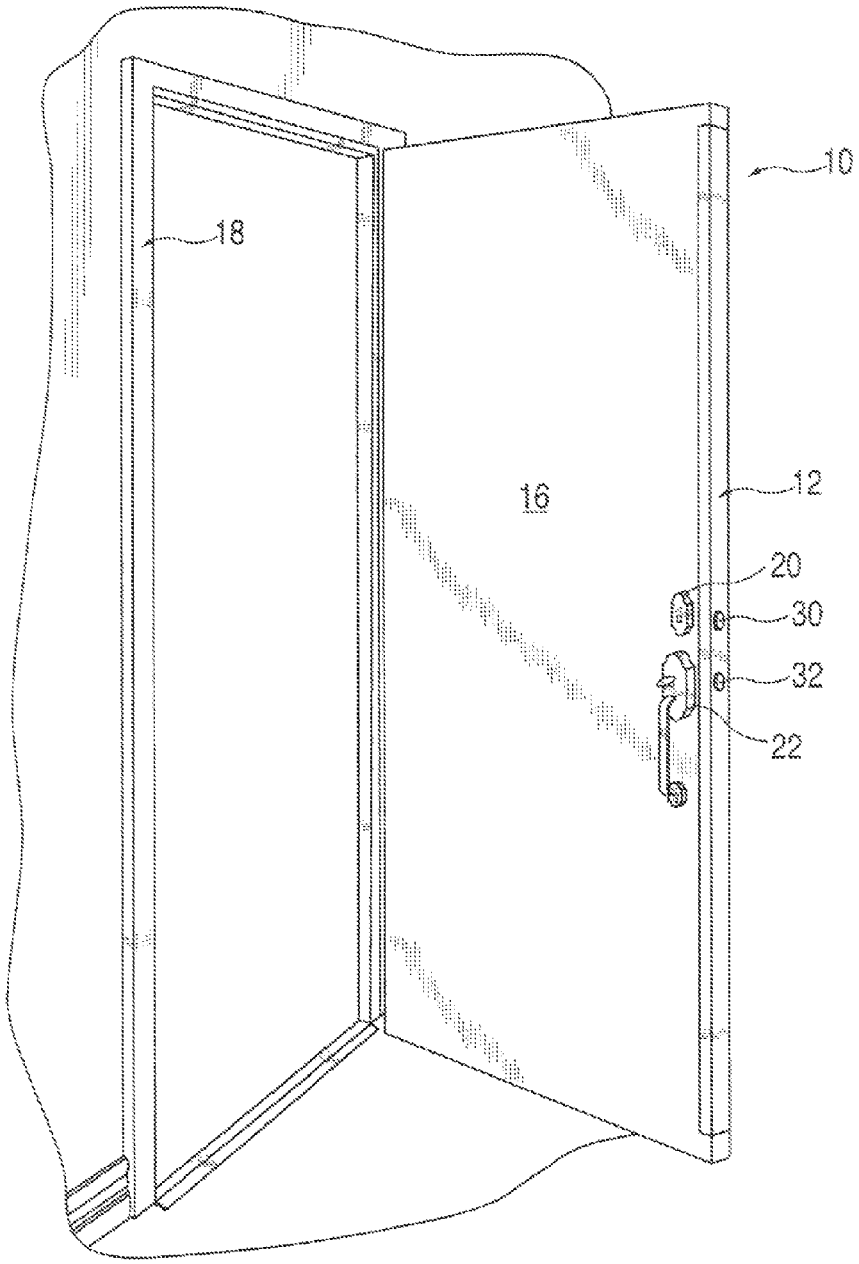
FIG. 2 is an isometric view of a first embodiment of the security device of the present invention.
Figure 2A:
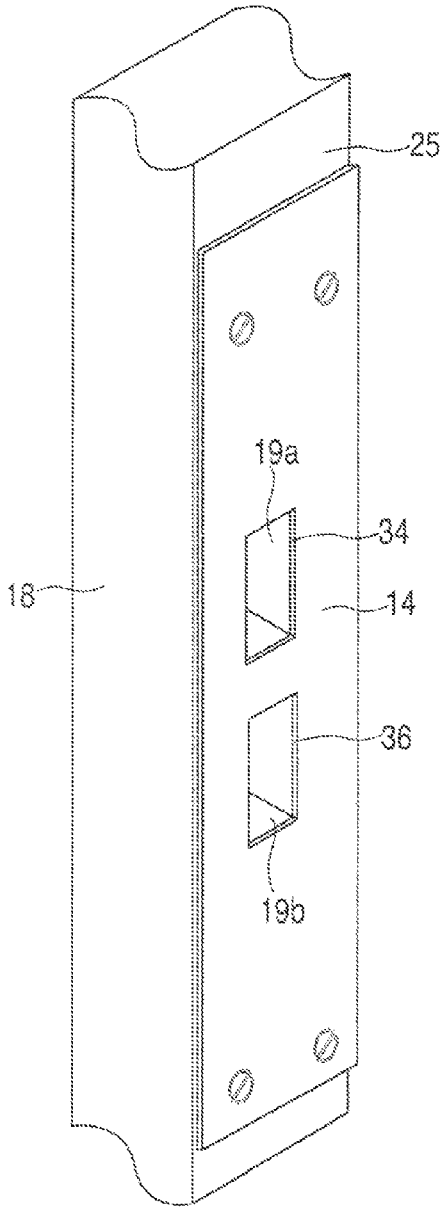
FIG. 2*a* is an isometric view of a section of the door frame and the frame plate of the security device of FIG. 2.
Figure 2B:
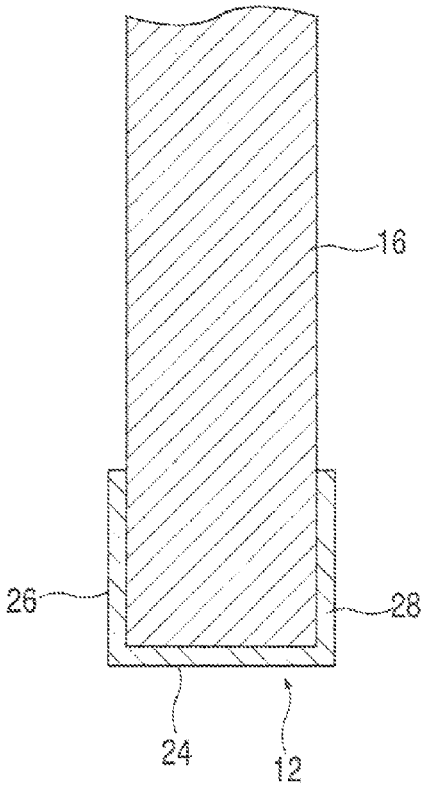
FIG. 2*b* is a cross-sectional view of a section of the door and the door reinforcing plate of the security device of FIG. 2.
Figure 3:
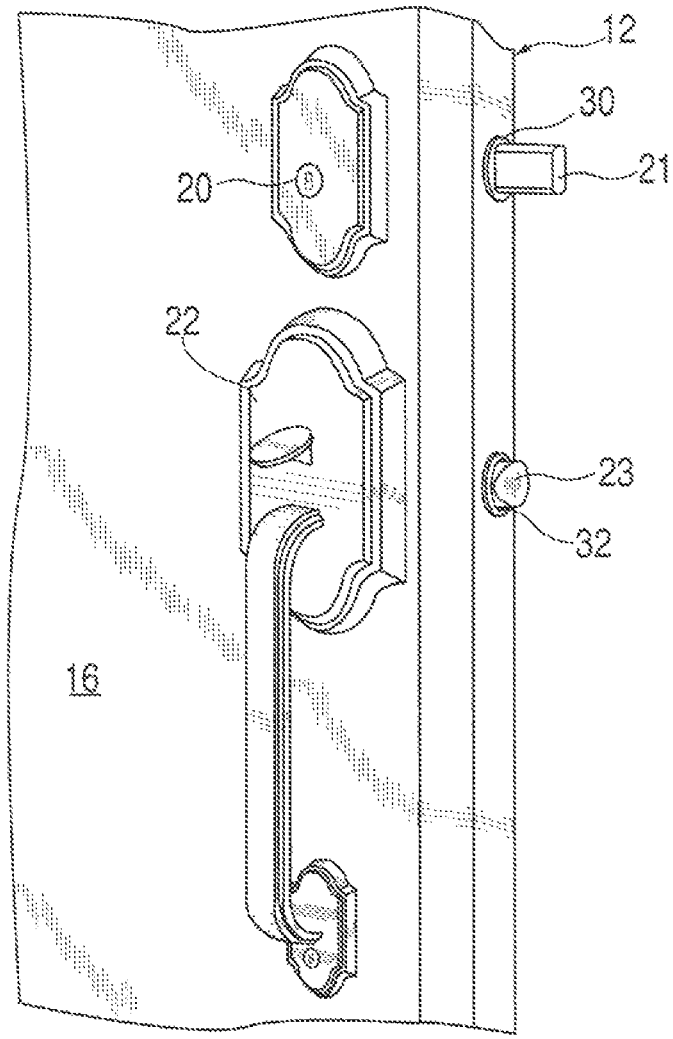
FIG. 3 is an isometric view of the security device of FIG. 2 showing a detail of the door latch and the deadbolt.

The door reinforcing plate 12 is angled and crimped into a U-shape, as shown in FIG. 2*b*, and includes an edge portion 24, an interior portion 26, an exterior portion 28, a deadbolt passage 30, and a door latch passage 32. The door reinforcing plate 12 is preferably a hardened metal such as cold rolled steel. Alternatively, the door reinforcing plate 12 is a different, suitably hard material such as brass or stainless steel. In the preferred embodiment, the door reinforcing plate 12 is affixed to the vertical edge of a door using a silicon adhesive. The door reinforcing plate 12 may be alternatively affixed to the door 16 using any suitable adhesive or fasteners such as wood screws or machine screws. Further, in the case that the door 16 is a metal door, the door reinforcing plate 12 may be affixed to the door 16 by welding or brazing. The deadbolt passage 30 and the door latch passage 32 are located over the deadbolt 21 and the door latch 23, respectively. Further the deadbolt 21 and the door latch 23 each are slideable within the deadbolt passage 30 and the door latch passage 32, respectively. The door reinforcing plate 12 preferably extends substantially the entire length of the door 16.

Referring to FIG. 2*a*, the frame plate 14 is a flat plate preferably made of cold rolled steel, brass, or stainless steel. Alternatively, the frame plate 14 is made of any sufficiently hard material. The frame plate 14 includes a first passage 34 and a second passage 36. The frame plate 14 is mounted to the frame 18 such that the first passage 34 communicates with the deadbolt receptacle 19*a* and the second passage 36 communicates with the door latch receptacle 19*b*. Further, when the door 16 is in the closed position, the deadbolt 21 is slideable within the first passage 34 to engage the deadbolt receptacle 19*a* and the door latch 23 is slideable within the second passage 36 to engage the door latch receptacle 19*b*. The frame plate 14 is preferably affixed to the frame 18 by wood screws or machine screws. Alternatively, the frame plate 14 is affixed to the frame 18 by an adhesive. The frame plate 14 may be used in conjunction with a strike plate (not shown). The frame plate 14 may be mounted over the strike plate. Alternatively, the frame plate 14 is mounted to the frame 18 and the strike plate is affixed to the frame plate 14. In the preferred embodiment, the frame plate 14 is at least 12 inches long and may extend the vertical length of the door frame 18.

In use, the door 16 is secured by closing the door 16 such that the door latch 23 engages the door latch receptacle 19*b* and the deadbolt lock assembly 20 is operated normally such that the deadbolt 21 engages the deadbolt receptacle 19*a*. When an impact is applied to the door 16 such as by an intruder trying to kick in the door 16 or when a crowbar is used to try and pry open the door 16, the deadbolt 21 transmits the force from the door 16 to the frame 18. The door reinforcing plate 12 and the frame plate 14 provide hard materials to reinforce the door 16 and the frame 18 where the deadbolt 21 is acting on them. Further, the door reinforcing plate 12 distributes the force applied to the door 16 by the deadbolt 21 along substantially the entire vertical edge of the door 16. The frame plate 14 distributes the force applied to the frame 18 by the deadbolt 21. This distribution of force in combination with the hard reinforcing materials allows the door 16 and the frame 18 to take a significantly increased amount of force applied by a would-be intruder.

Figure 4:
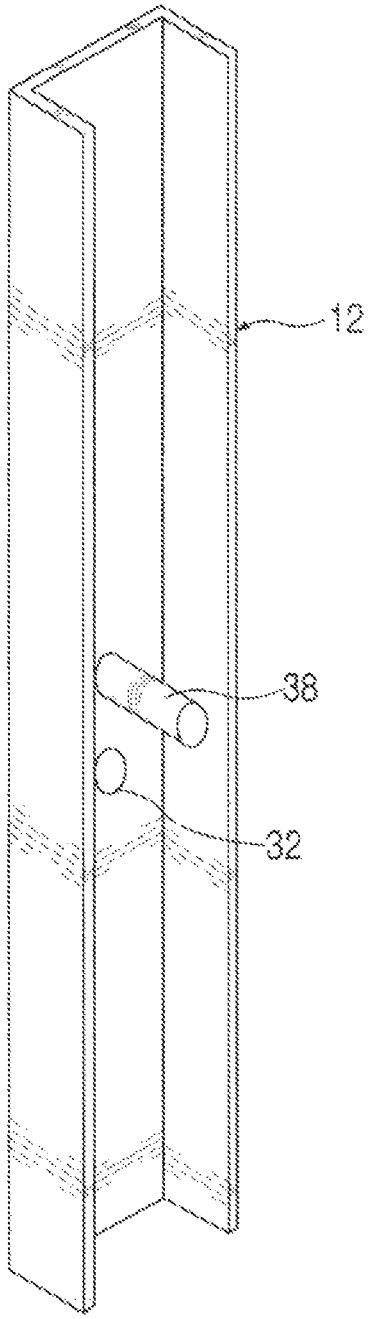
FIG. 4 is an isometric view of a second embodiment of the security device of the present invention showing a section of the door reinforcing plate.

Referring now to FIG. 4, a second embodiment of the security system is shown. FIG. 4 shows a section of the door reinforcing plate 12 including the door latch passage 32 and a deadbolt guard 38. The deadbolt guard 38 slides over the deadbolt 21 as the door reinforcing plate 12 is affixed to the door 16 as described in the first embodiment. The deadbolt 21 is slideable within the deadbolt guard 38. The deadbolt guard 38 provides further reinforcement of the door 16. The deadbolt guard 38 is preferably integral with the door reinforcing plate 12. Alternatively, the deadbolt guard 38 is affixed to the door reinforcing plate 12 by any suitable method such as welding, brazing, epoxy, or use of fasteners.

Figure 5:
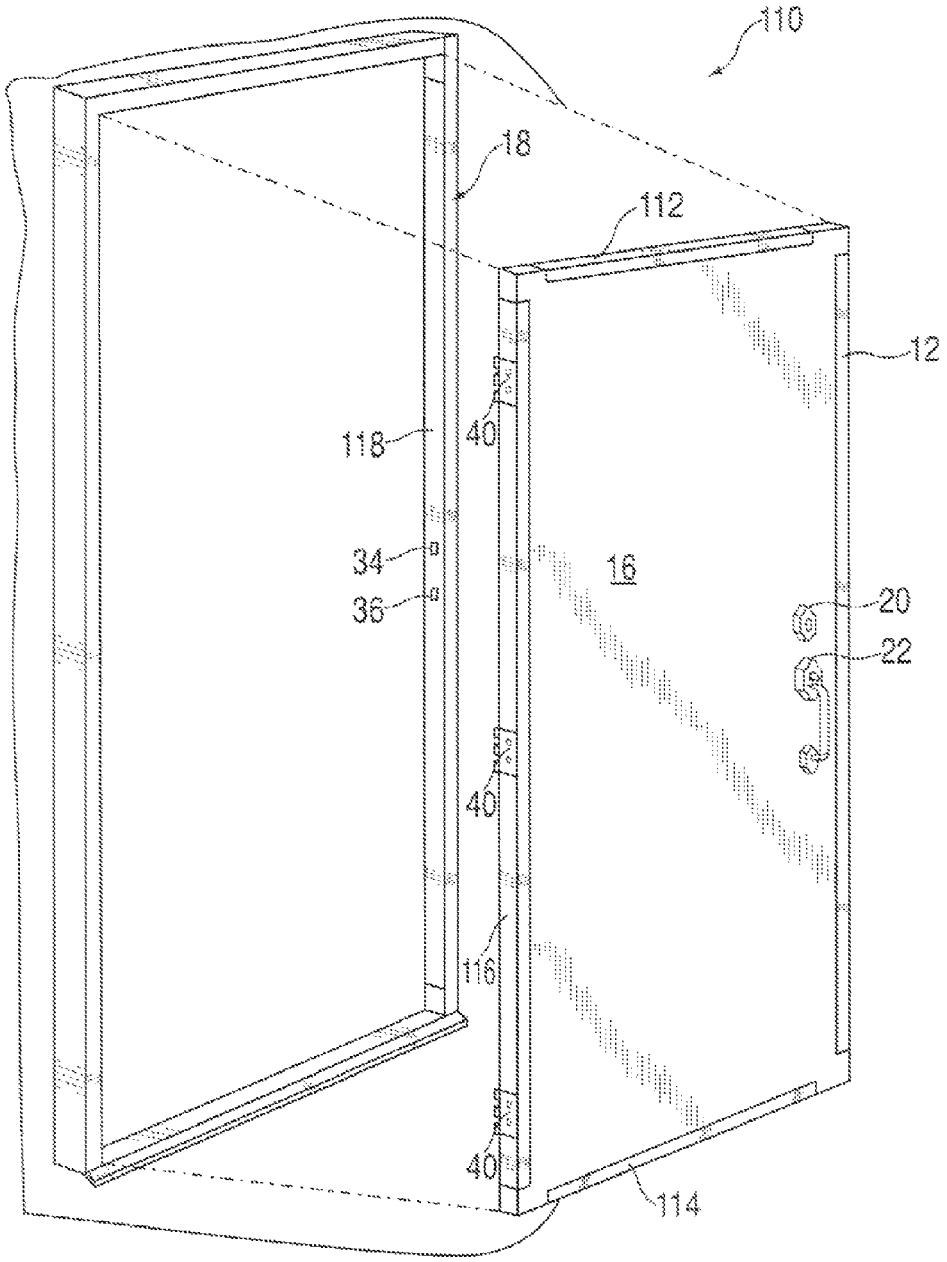
FIG. 5 is an isometric view of a third embodiment of the security device of the present invention.

A third embodiment of the security device is shown in FIG. 5. The security device 110 includes the door reinforcing plate 12 as described in the first embodiment. The security device 110 further includes a top edge reinforcing plate 112, a bottom edge reinforcing plate 114, a second vertical edge reinforcing plate 116, and an elongated frame plate 118. Each of the top edge plate 112, the bottom edge plate 114, and the second vertical edge plate 116 is U-shaped and affixed to the respective edge in substantially the same manner as the door reinforcing plate 12 is affixed to the door 16. Door hinges 40 are affixed to the second vertical edge plate 116. The second vertical edge plate 116 may be mortised such that the hinges 40 are flush with the outer surface of the second vertical edge plate 116. The elongated frame plate 118 is affixed to the frame 18 in the same manner as frame plate 14 is affixed to frame 18. Further, the elongated frame plate 118 includes the first passage 34 in communication with the deadbolt receptacle 19*a* and the second passage 36 in communication with the door latch receptacle 19*b*. In use, the security device 110 works in substantially the same manner as the security device 10. The added door reinforcing plates and the elongated frame plate further reinforce the door 16 and the frame 18, respectively, and further distributes the forces applied to the door 16 and the frame 18 by a would-be intruder-especially forces applied to areas of the door 16 that are remote from the deadbolt 21.

Figure 6:
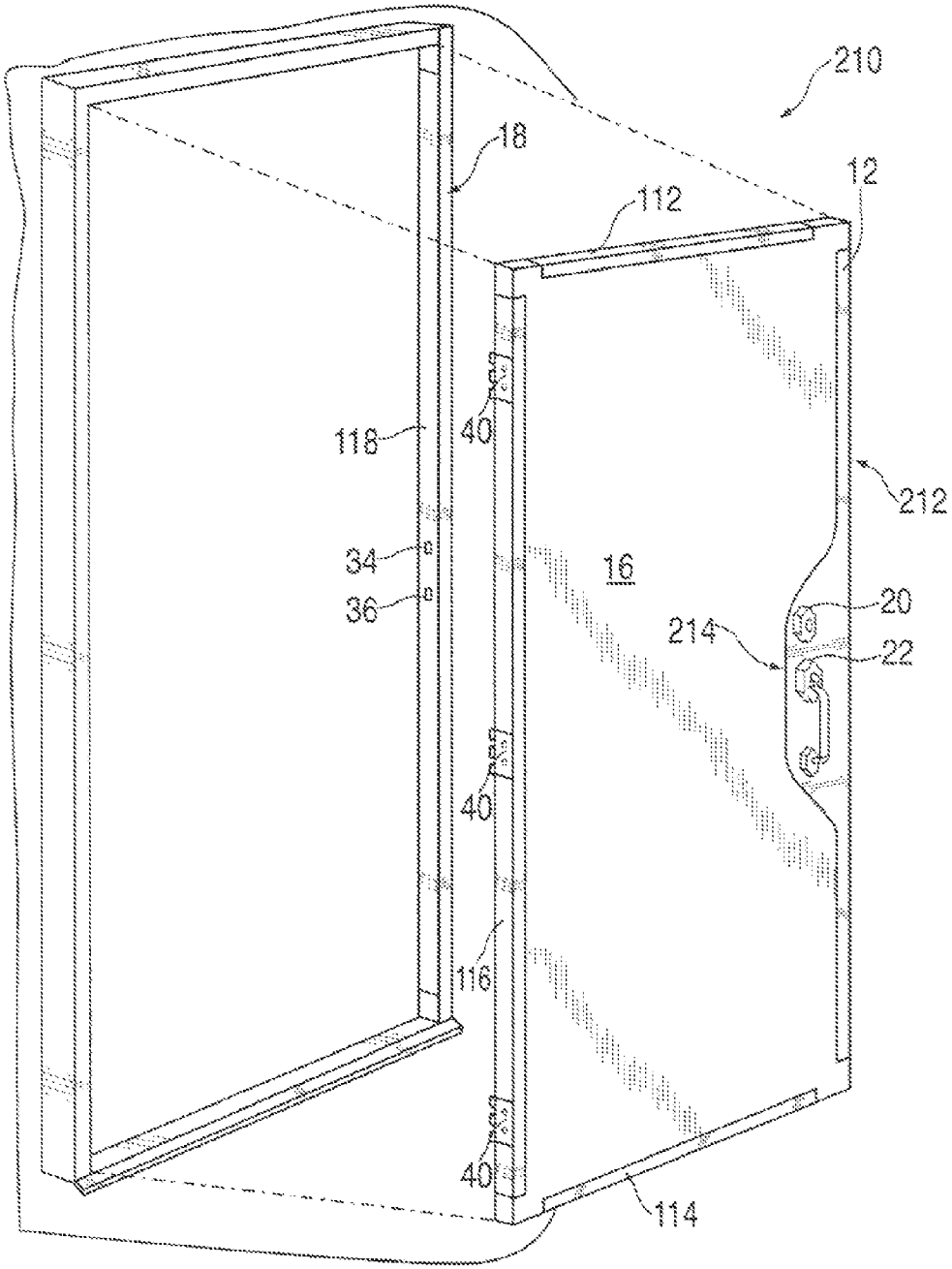
FIG. 6 is an isometric view of a forth embodiment of the security device of the present invention.

In a forth embodiment, FIG. 6 shows security device 210. The security device 210 includes the top edge reinforcing plate 112, the bottom edge reinforcing plate 114, the second vertical edge reinforcing plate 116, and the elongated frame plate 118. The security device further includes an enhanced door reinforcing plate 212, which includes all the features of the door reinforcing plate 12 with the added feature of a widened central portion 214. The widened central portion 214 covers an area large enough to encompass the deadbolt lock assembly 20 and the door latch assembly 22 and is located on the interior and exterior surfaces of the door 16. This provides further reinforcement of the door 16 in the place that it is most likely to fail under the stress applied by an intruder and it further distributes the applied forces.

It should be particularly noted that the edges of the door 16 may be mortised such that the outer surfaces of the door reinforcing plate 12, the top edge plate 112, the bottom edge plate 114, and the second vertical edge plate 116 are flush with the outer surface of the door 16. This may improve the way the door fits in the door frame and avoid misalignment issues between the deadbolt and the deadbolt receptacle.

Experimentation has shown that the security device disclosed in the first embodiment is sufficient to thwart an intruder. The added hardened materials required for the subsequent embodiments may increase the strength of the door and security device, however, they also increase the weight and cost of the same.

It should be even further particularly noted that an advantage of the invention is that the security device may be used with a new or existing door and door frame. Further, the security device may be installed on a door and door frame made of substantially any material. This provides the ability to retrofit doors or even to rehabilitate and improve doors that have been broken into.

While the invention has been described with reference to certain embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments falling within the scope and spirit of the appended claims.

The invention claimed is:

1. A security combination for a doorway comprising:

a door frame having at least one opening to receive a locking member, a door sized and shaped to fit within the door frame, the door having a front surface, a rear surface, a top surface, a bottom surface, a free vertical edge portion, and a hinged vertical edge portion, the free vertical edge portion comprising at least one lockset, the lockset having a portion protruding through the front surface of the door and a locking member, a first U-shaped reinforcing member consisting of a base member and two substantially perpendicularly positioned side members, the first U-shaped reinforcing member being securely affixed to the free vertical edge portion of the door, said first U-shaped reinforcing member being made of a metal material, extending substantially along the full length of the free vertical edge portion of the door, the base member having at least one opening for passage of the locking member of the at least one lockset, each of the side members being flat and generally rectangular and extending substantially along the free vertical edge portion of the door and having a proximal edge connected to the base member and a distal edge, wherein the distal edge of each of the side members does not extend in a horizontal direction from the free vertical edge portion towards the hinged vertical edge portion beyond any part of the portion of the lockset protruding through the front surface of the door, and a second reinforcing member capable of being securely affixed to the door frame, said second reinforcing member having at least one opening for passage of the locking member of the at least one lockset, wherein the first U-shaped reinforcing member is overbend mounted to the free vertical edge portion of the door so that the first U-shaped reinforcing member engages the free vertical edge portion of the door without being screwed to the door, and, wherein the second reinforcing member has a length of from about 12 inches to substantially the full length of the free vertical edge portion of the door, and wherein force applied against the front or rear surface of the door will be transmitted through the locking member to the second reinforcing member and to the door frame.

2. The security combination of claim 1, wherein the at least one lockset is a deadbolt locking set and the locking member is a deadbolt.

3. The security combination of claim 2, wherein the at least one lockset is a door latch set and the locking member is a door latch.

4. The security combination of claim 1, wherein first and second reinforcing members are each comprised of metal.

5. The security combination of claim 4, wherein the metal is cold-rolled steel, stainless steel, or brass.

6. The first security combination of claim 1, wherein the U-shaped reinforcing member is further affixed to the free vertical edge portion of the door by adhesive.

7. The security combination of claim 6, wherein the adhesive is silicon adhesive.

8. The security combination of claim 1, wherein the door is a metal door.

9. The security combination of claim 1 wherein each of the side members has a substantially planar surface extending from the proximal edge of the side member to the distal edge of the side member.

10. The security combination of claim 9 wherein the side members of the first U-shaped reinforcing member protrude from the front surface of the door and the rear surface of the door.

11. The security combination of claim 1 wherein the side members of the first U-shaped reinforcing member protrude from the front surface of the door and the rear surface of the door.

* * * * *